US010926380B2

(12) United States Patent
Tai et al.

(10) Patent No.: US 10,926,380 B2
(45) Date of Patent: Feb. 23, 2021

(54) CLAMPING DEVICE AND CLAMPING SYSTEM USING THE SAME

(71) Applicant: INDUSTRIAL TECHNOLOGY RESEARCH INSTITUTE, Hsinchu (TW)

(72) Inventors: Chung-Yu Tai, Kaohsiung (TW); Qi-Zheng Yang, Taoyuan (TW); Ke-Hen Chen, Taichung (TW); Ta-Jen Peng, Taichung (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 231 days.

(21) Appl. No.: 16/234,180

(22) Filed: Dec. 27, 2018

(65) Prior Publication Data

US 2020/0171624 A1 Jun. 4, 2020

(30) Foreign Application Priority Data

Nov. 30, 2018 (TW) ..... 107143051

(51) Int. Cl.
*B25B 5/00* (2006.01)
*B25B 5/14* (2006.01)
*B25B 5/06* (2006.01)

(52) U.S. Cl.
CPC ..... *B25B 5/003* (2013.01); *B25B 5/061* (2013.01); *B25B 5/14* (2013.01)

(58) Field of Classification Search
CPC .... B25B 1/00; B25B 1/02; B25B 1/04; B25B 5/00; B25B 5/02; B25B 5/04; B25B 11/00; B23Q 3/00; B23Q 3/06; B23P 11/00
See application file for complete search history.

(56) References Cited

U.S. PATENT DOCUMENTS 2,754,708 A * 7/1956 Peterson ..... B25B 1/2421 269/224
3,868,102 A * 2/1975 Pevar ..... B25B 1/2421 269/26

(Continued)

FOREIGN PATENT DOCUMENTS

CN 203092154 U 7/2013
CN 103419049 A 12/2013

(Continued)

OTHER PUBLICATIONS

Baik, "High damping Fe—Mn martensitic alloys for engineering applications," Nuclear Engineering and Design 198 (2000), pp. 241-252.

(Continued)

*Primary Examiner* — Lee D Wilson
(74) *Attorney, Agent, or Firm* — Birch, Stewart, Kolasch & Birch, LLP

(57) ABSTRACT

A clamping device includes a first holder and a second holder. The first holder includes a first abutting member and a driving member. The driving member is coupled to the first abutting member. The second holder includes a second abutting member. The first abutting member and the second abutting member are oppositely disposed and spaced apart from each other to receive a workpiece. The driving member is coupled to the first abutting member to drive the first abutting member to move in a direction toward the second abutting member to clamp the workpiece between the first abutting member and the second abutting member.

20 Claims, 7 Drawing Sheets

(56) References Cited

U.S. PATENT DOCUMENTS

| | | | | |
|---|---|---|---|---|
| 3,923,414 | A | 12/1975 | Hopkins | |
| 4,572,564 | A * | 2/1986 | Cipolla | B25B 1/2421 269/266 |
| 5,494,269 | A | 2/1996 | McCalmont | |
| 5,555,178 | A | 9/1996 | Hashimoto | |
| 2011/0291342 | A1* | 12/2011 | Gindy | B25B 1/2421 269/266 |
| 2014/0283368 | A1 | 9/2014 | Geng | |
| 2020/0171624 | A1* | 6/2020 | Tai | B25B 5/003 |

FOREIGN PATENT DOCUMENTS

| | | | |
|---|---|---|---|
| CN | 203956584 | U | 11/2014 |
| CN | 204565699 | U | 8/2015 |
| CN | 205271539 | U | 6/2016 |
| CN | 105817930 | A | 8/2016 |
| CN | 106271716 | A | 1/2017 |
| CN | 104589118 | B | 8/2017 |
| CN | 108297003 | A | 7/2018 |
| CN | 207577971 | U | 7/2018 |
| CN | 207953285 | U | 10/2018 |
| JP | 63-123654 | A | 5/1988 |
| JP | 8-294836 | A | 11/1996 |
| JP | 2014-83674 | A | 5/2014 |
| TW | M298309 | U | 9/2006 |
| TW | 200942358 | A | 10/2009 |
| TW | 201226101 | A | 7/2012 |
| TW | M491863 | U | 12/2014 |
| TW | I630071 | B | 7/2018 |
| TW | 201839536 | A | 11/2018 |

OTHER PUBLICATIONS

Daghini et al., "Design, Implementation and Analysis of Composite Material Dampers for Turning Operations," International Journal of Mechanical, Aerospace, Industrial, Mechatronic and Manufacturing Engineering vol. 3, No. 5, 2009, pp. 556-563.

Kim et al., "Numerical analysis and parameter study of a mechanical damper for use in long slender endmills," International Journal of Machine Tools & Manufacture 46 (2006), pp. 500-507.

Maui et al., "Plate insertion as a means to improve the damping capacity of a cutting tool system," International Journal of Machine Tools & Manufacture 38 (1998), pp. 1209-1220.

Miguèlez et al., "Improvement of chatter stability in boring operations with passive vibration absorbers," International Journal of Mechanical Sciences 52 (2010), pp. 1376-1384.

Wakasawa et al., "The damping capacity improvement of machine tool structures by balls packing," International Journal of Machine Tools & Manufacture 44 (2004), pp. 1527-1536.

Yang et al., "Optimization of multiple tuned mass dampers to suppress machine tool chatter," International Journal of Machine Tools & Manufacture 50 (2010), pp. 834-842.

Chinese Office Action and Search Report for Chinese Application No. 201811569730.8, dated Nov. 4, 2020.

* cited by examiner

CLAMPING DEVICE AND CLAMPING SYSTEM USING THE SAME

This application claims the benefit of Taiwan application Serial No. 107143051, filed Nov. 30, 2018, the disclosure of which is incorporated by reference herein in, its entirety.

TECHNICAL FIELD

This disclosure relates to a clamping device and a clamping system using the same, and more particularly to a clamping device having driving holders and a clamping system using the same.

BACKGROUND

At present, the way of clamping a workpiece is to increase the clamping force, but the clamping force is constant. However, with the change in the geometric pattern of the workpiece in the machining process (a part of material is removed), the natural frequency of the overall system constituted by the machine tool and the workpiece also changes therewith. This adversely results in the sudden resonance phenomenon in the machining process. The resonance phenomenon inevitably deteriorates the surface qualities of the workpiece. Thus, how to propose a new clamping device is one of the directions of the industry's efforts.

SUMMARY

According to one embodiment of this disclosure, a clamping device is provided. The clamping device includes a first holder and a second holder. The first holder includes a first abutting member and a first driving member. The first driving member is coupled to the first abutting member. The second holder includes a second abutting member. The first abutting member and the second abutting member are oppositely disposed and spaced apart from each other to receive a workpiece. The first driving member is coupled to the first abutting member to drive the first abutting member to move in a direction toward the second abutting member to clamp the workpiece between the first abutting member and the second abutting member.

According to another embodiment of this disclosure, a clamping system is provided. The clamping system includes the above-mentioned clamping device, a sensor and a processor. The clamping device is installed on a machine tool and clamps a workpiece, wherein the machine tool, the clamping device and the workpiece form a machine tool system. The sensor senses response signals of the machine tool system. The processor analyzes the response signals to obtain equation of motion of the response signals; introduces a first stiffness coefficient of the first abutting member and a second stiffness coefficient of the second abutting member into the equation of motion to obtain an optimum system's natural frequency corresponding to a first optimum stiffness coefficient and a second optimum stiffness coefficient; and controls the first driving member of the clamping device to drive the first abutting member to move in a direction toward the second abutting member to deform the first abutting member and the second abutting member, so that the first stiffness coefficient of the first abutting member satisfies the first optimum stiffness coefficient and the second stiffness coefficient of the second abutting member satisfies the second optimum stiffness coefficient.

The above and other aspects of this disclosure will become better understood with regard to the following detailed description of the preferred but non-limiting embodiments. The following description is made with reference to the accompanying drawings.

Figure 1:
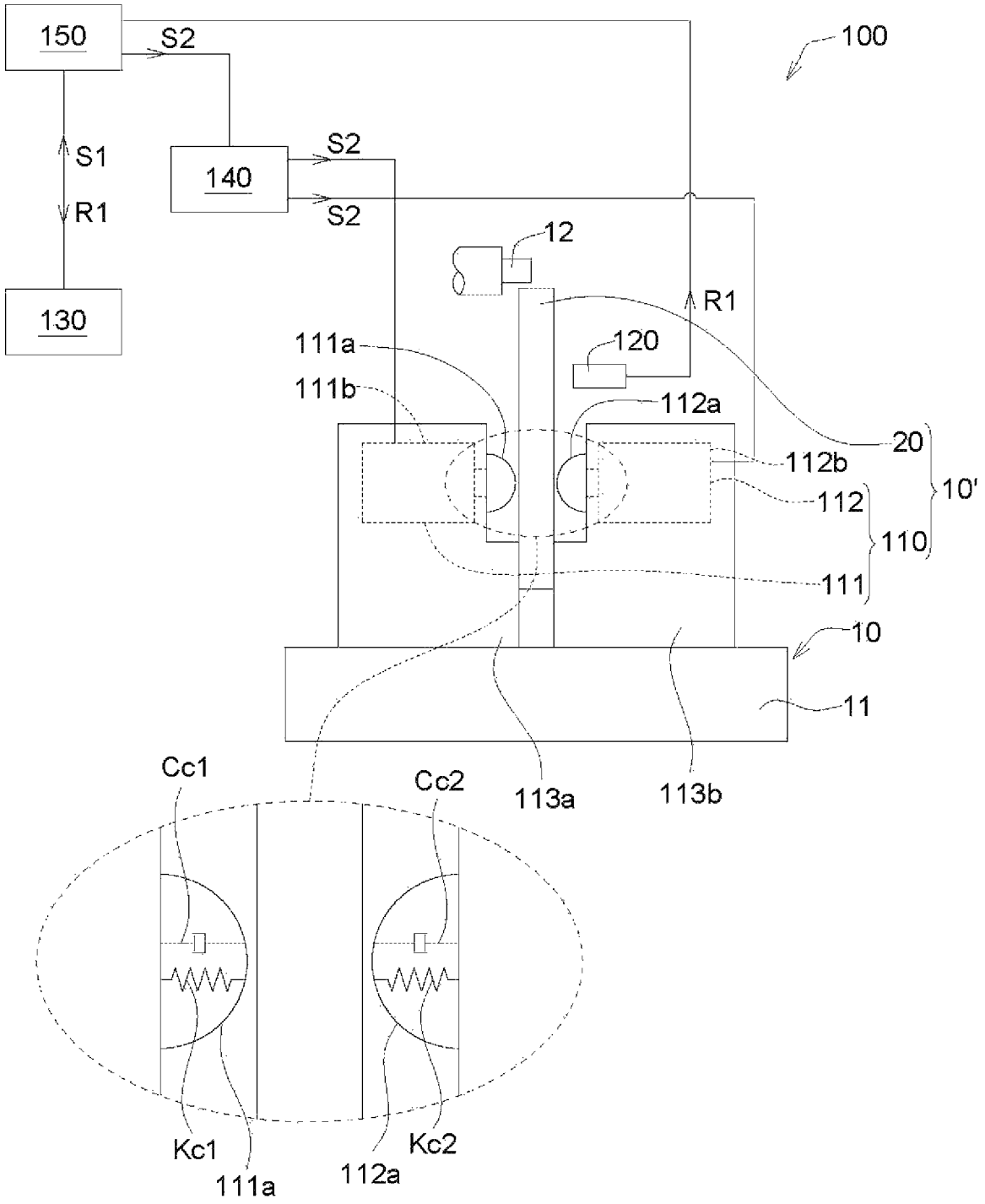
FIG. 1 is a top view showing a clamping system according to an embodiment of this disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

FIG. 1 is a top view showing a clamping system 100 according to an embodiment of this disclosure. Referring to FIG. 1, the clamping system 100 includes a clamping device 110, a sensor 120, a processor 130, an amplifier 140 and data acquisition (DAQ) 150. The DAQ 150 is electrically connected to the sensor 120, the processor 130 and the amplifier 140 to collect and/or transmit signals between these components. The processor 130 and the amplifier 140 are circuit structures (circuits) formed by using the semiconductor process, for example. The DAQ 150 is, for example, a physical machine, and includes at least one circuit structure for collecting and/or processing data.

The clamping device 110 is mounted on a machine tool 10 and clamps a workpiece 20. The clamping device 110 includes at least one first holder 111 and at least one second holder 112. The machine tool 10 includes a platen 11, a tool 12, a first clamping base 113*a* and a second clamping base 113*b*. The first clamping base 113*a* and the second clamping base 113*b* may be mounted on the platen 11. The first clamping base 113*a* and the second clamping base 113*b* may be moved relative to each other to clamp the workpiece 20 or release the workpiece 20. In addition, the first clamping base 113*a*, the second clamping base 113*b* and the clamping device 110 of the machine tool 10 and the workpiece 20 may constitute a machine tool system 10'. However, according to the actual situation, the machine tool system 10' may further include at least one portion of platform 11, or further include at least a portion of platform 11 and other portions of the machine tool 10.

The first holder 111 and the second holder 112 are disposed in the first clamping base 113*a* and the second clamping base 113*b*, respectively. In another embodiment, positions of the first holder 111 and the second holder 112 of FIG. 1 may also be exchanged. The first holder 111 includes a first abutting member 111*a* and a first driving member 111*b*, wherein the first driving member 111*b* is connected to the first abutting member 111*a*. The first driving member 111*b* can control the magnitude of a first force F1 (see FIG. 3) of the first abutting member 111*a* exerting on the workpiece 20. The second holder 112 includes a second abutting member 112*a* and a second driving member 112*b*, wherein the second driving member 112*b* is connected to the second abutting member 112*a*. The second driving member 112*b* may control the magnitude of a second force F2 (see FIG. 3) of the second abutting member 112*a* exerting on the workpiece 20.

The first abutting member 111*a* and/or the second abutting member 112*a* are/is, for example, a deformable material, whose damping coefficient and/or stiffness coefficient can be changed according to different deformation amounts. For example, as shown in FIG. 1, the first abutting member 111*a* has a first damping coefficient $C_{C1}$. The first damping coefficient $C_{C1}$ satisfies the following equation (1). In the equation (1), SDC denotes the specific damping capacity (SDC) of the material of the first abutting member 111*a*, and $S_t$ denotes the tensile strength of the material of the first abutting member 111*a*.

$$C_{C1}=\mathrm{SDC}\times S_t \tag{1}$$

Regarding the specific material, the material of the first abutting member 111*a* may include magnesium (Mg), manganese (Mn), copper (Cu), zirconium (Zr), iron (Fe), aluminum (Al), nickel (Ni), titanium (Ti) or a combination thereof, such as a manganese zirconium alloy, a manganese copper alloy, a copper aluminum nickel alloy, an iron manganese alloy, a nickel titanium alloy or a magnesium zirconium alloy.

In addition, a second damping coefficient $C_2$ of the second abutting member 112*a* is similar to or the same as the first damping coefficient $C_{c1}$, and the material of the second abutting member 112*a* is selected from the material similar to or the same as the first damping coefficient $C_{c1}$, and detailed descriptions thereof will be omitted here.

The sensor 120 is used to sense a response signal R1 of the workpiece 20. The response signal R1 is, for example, a response amplitude change in the time domain or a response intensity change in the frequency domain. In an embodiment, the sensor 120 is, for example, a non-contact vibration sensor, such as a microphone, a laser displacement meter or a laser Doppler vibrometer.

The processor 130 is used to perform at least the following steps of (a) analyzing the response signal R1 to obtain an equation of motion of the response signal R1; (b) introducing a first stiffness coefficient $K_{c1}$ of the first abutting member 111*a* and a second stiffness coefficient $K_{c2}$ of the second abutting member 112*a* into the equation of motion to obtain an optimum system's natural frequency corresponding to a first optimum stiffness coefficient and a second optimum stiffness coefficient; and (c) controlling the first driving member 111*b* of the clamping device 110 to drive the first abutting member 111*a* to move in the direction of the second abutting member 112*a* to deform the first abutting member 111*a* and the second abutting member 112*a*, and thus to make the first stiffness coefficient of the first abutting member 111*a* satisfy the first optimum stiffness coefficient and make the second stiffness coefficient of the second abutting member 112*a* satisfy the second optimum stiffness coefficient.

Figure 2:
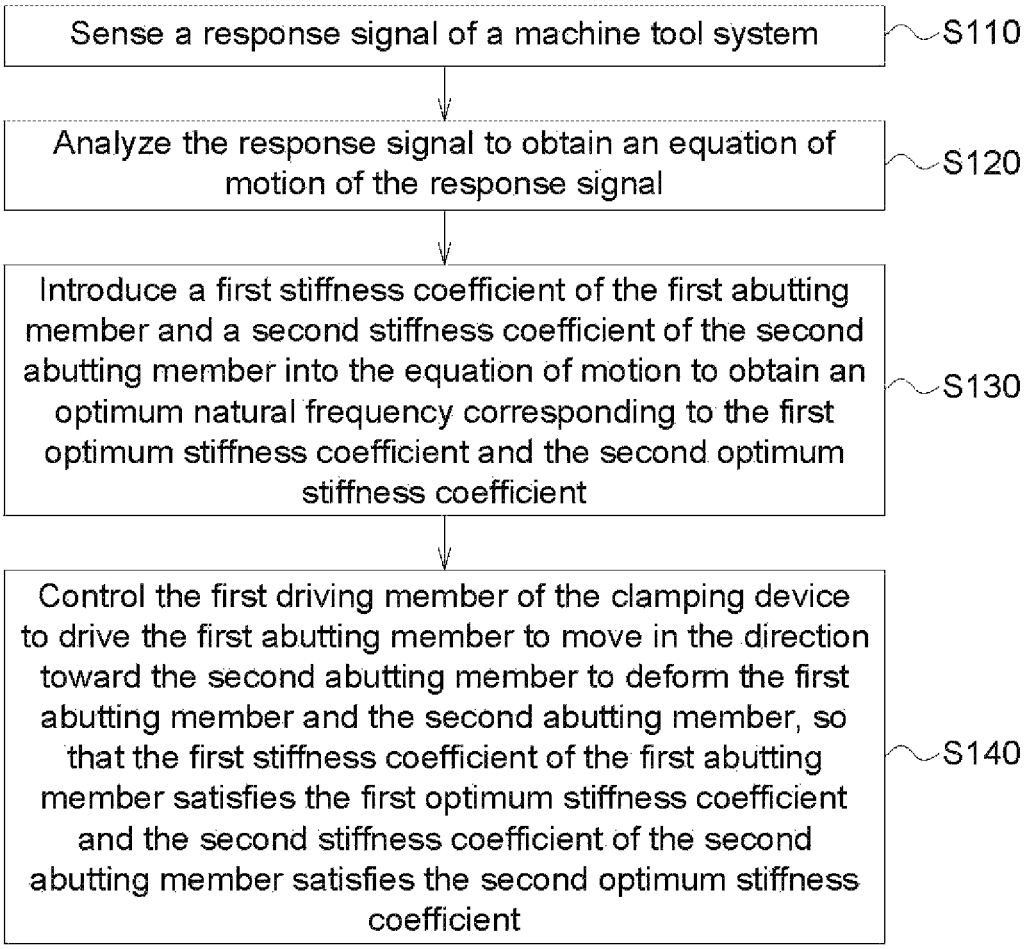
FIG. 2 is a flow chart showing a clamp control method of the clamping system 100 of FIG. 1.

The following is a further description of the operation process of the clamping system with reference to the flow chart of FIG. 2. FIG. 2 is a flow chart showing a clamp control method of the clamping system 100 of FIG. 1.

In a step S110, before processing, the first clamping base 113*a* and the second clamping base 113*b* clamp a lower portion of the workpiece 20. Then, the sensor 120 senses the response signal R1 of the workpiece 20. For example, an excitation mode may be used (e.g., to input an instantaneous knocking force, such as a pulse signal, to the workpiece 20) to sense the response signal R1 of the workpiece 20. As shown in FIG. 1, the response signal R1 may be transmitted to the processor 130 through the DAQ 150.

In addition, before the sensor 120 senses the response signal R1 of the workpiece 20, as shown in FIG. 1, the first abutting member 111*a* and the second abutting member 112*a* of the clamping device 110 cannot touch the workpiece 20, but may also slightly touch the workpiece 20, so that the workpiece 20 may be slightly clamped between the first abutting member 111*a* and the second abutting member 112*a*. This can stabilize the relative position between the workpiece 20 and the clamping device 110.

In a step S120, the processor 130 analyzes the response signal R1 to get the equation of motion of the response signal R1, as shown in the following equation (2). The equation of motion has, for example, a mathematical form of $M\ddot{x}+C\dot{x}+Kx=0$, where M in the equation (2) denotes the system mass of the machine tool system 10', C denotes the system's damping coefficient of the machine tool system 10', and K denotes the system's stiffness coefficient of the machine tool system 10'. The equation (2) may be converted into the Fourier form vibration response H(w) as shown in the following equation (3), wherein as the absolute value of the vibration response H(w) gets smaller, the amplitude gets smaller; and on the contrary, the amplitude gets greater.

$$M\ddot{x}+C\dot{x}+Kx=0 \tag{2}$$

$$|H(\omega)|=\frac{1/M}{\sqrt{(\omega_n^2+\omega^2)^2+(2p\omega_n\omega)^2}} \tag{3}$$

In the equation (3), $\omega_n$ denotes the system's natural frequency of the machine tool system 10', ω denotes the working frequency (upon processing), and p denotes the damping ratio.

In a step S130, the processor 130 introduces the first stiffness coefficient $K_{c1}$ of the first abutting member 111*a* and the second stiffness coefficient $K_{c2}$ of the second abutting member 112*a* into the equation (2) to obtain the optimum system's natural frequency $\omega_{n,B}$, which corresponds to the first optimum stiffness coefficient $K_{c1,B}$ and the second optimum stiffness coefficient $K_{c2,B}$. That is, the first optimum stiffness coefficient $K_{c1,B}$ and the second optimum stiffness coefficient $K_{c2,B}$ constitute one of the prerequisites for obtaining the optimum system's natural frequency $\omega_{n,B}$. In an embodiment, the processor 130 may adopt the theory or equation of vibration. According to the equation (2), the equation (3) or any other required equation, the stiffness coefficient, the damping coefficient, the mass, frequency and/or the like are/is calculated to obtain the optimum system's natural frequency $\omega_{n,B}$. In addition, the optimum system's natural frequency $\omega_{n,B}$ is, for example, the sum of the system's natural frequency $\omega_n$ of the equation (3) and the adjustment frequency, the processor 130 determines (or calculates) the first optimum stiffness coefficient $K_{c1,B}$ and the second optimum stiffness coefficient $K_{c2,B}$ under the precondition of satisfying this sum. The adjustment frequency is a system's vibration frequency changed when the first stiffness coefficient Kc1 and the second stiffness coefficient Kc2 are adjusted to the first optimum stiffness coefficient Kc1, B and the second optimum stiffness coefficient Kc2,B. In an embodiment, the natural frequency $\omega_n$ may be, for example, n modal natural frequencies, where n is, for example, a value ranging from 1 to 3, but may be greater or smaller.

Figure 3:
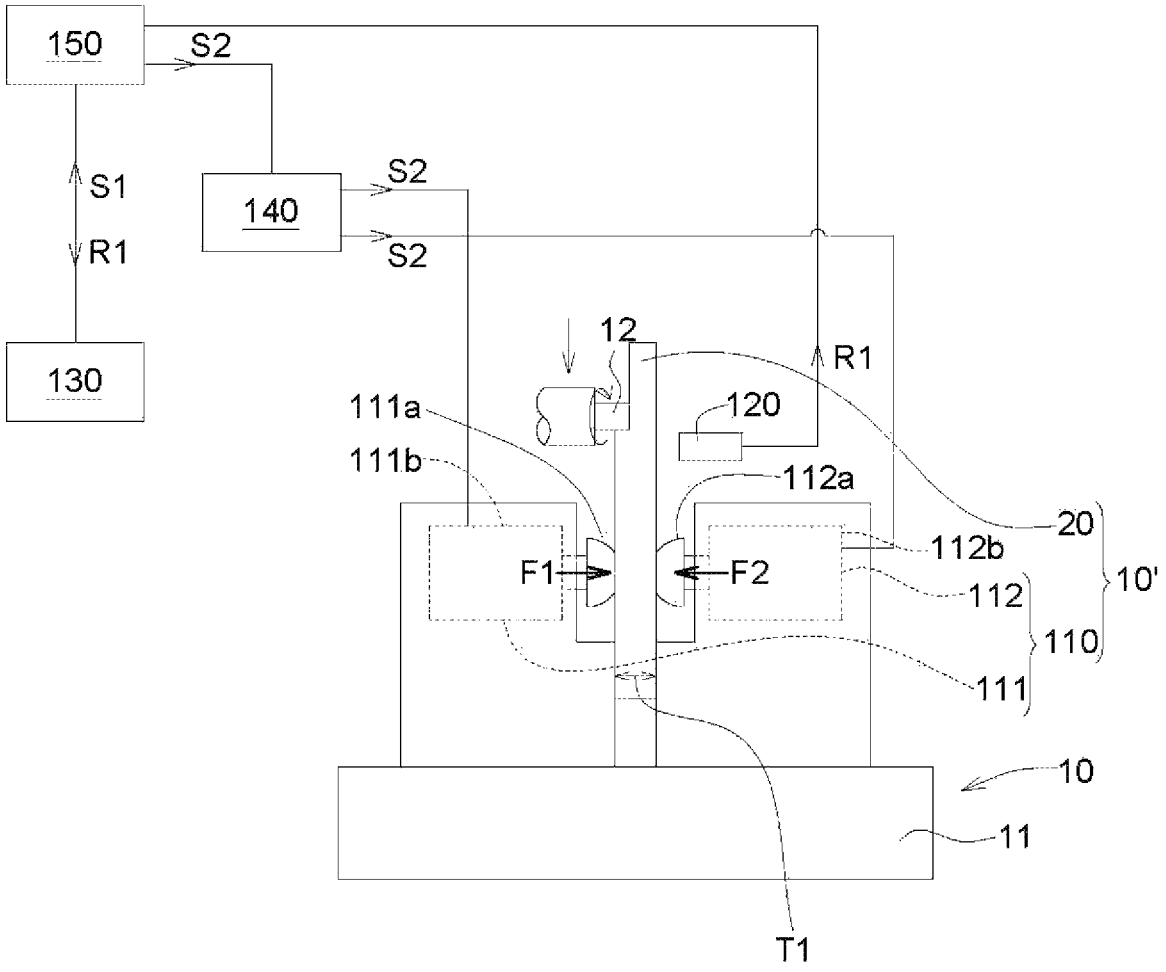
FIG. 3 is a schematic view showing deformations of a first abutting member and a second abutting member of FIG. 1.

FIG. 3 is a schematic view showing deformations of the first abutting member 111*a* and the second abutting member 112*a* of FIG. 1. In a step S140, as shown in FIG. 3, the processor 130 controls the first driving member 111*b* of the first holder 111 to drive the first abutting member 111*a* to move in a direction toward the workpiece 20 (or the second abutting member 112*a*), and controls the second driving member 112*b* of the second holder 112 to drive the second abutting member 112*a* to move in a direction toward the workpiece 20 (or the first abutting member 111*a*) to deform the first abutting member 111*a* and the second abutting member 112*a*. The first stiffness coefficient $K_{c1}$ of the first abutting member 111*a* increases or changes after deformation to satisfy the first optimum stiffness coefficient $K_{c1,B}$; and the second stiffness coefficient $K_{c2}$ of the second abutting member 112*a* increases or changes after deformation to satisfy the second optimum stiffness coefficient $K_{c2,B}$ to make the system's natural frequency $\omega_n$ of the machine tool system 10' of the equation (3) satisfy the optimum system's natural frequency $\omega_{n,B}$. Because the optimum system's natural frequency $\omega_{n,B}$ increases, the working frequency $\omega$ during processing cannot easily approach the optimum system's natural frequency $\omega_{n,B}$, or is held with a security frequency range (e.g., the adjustment frequency) from the optimum system's natural frequency $\omega_{n,B}$. Therefore, it is possible to effectively avoid the occurrence of resonance and achieve the effect of active vibration reduction.

In addition, the first damping coefficient $C_{c1}$ of the first abutting member 111*a* also increases after deformation, and the second damping coefficient $C_{c2}$ of the second abutting member 112*a* also increases after deformation, so that the damping ratio p of the equation (3) can be increased, and thus the system's natural frequency $\omega_n$ of the machine tool system 10' of the equation (3) can approach the optimum system's natural frequency $\omega_{n,B}$.

As shown in FIG. 3, the first force F1 exerted on the workpiece 20 by the first abutting member 111*a* after deformation and the second force F2 exerted on the workpiece 20 by the second abutting member 112*a* after deformation are also increased to further increase the clamping force of the clamping device 110 on the workpiece 20.

In addition, as shown in FIG. 3, a processor 140 can be controlled to provide a corresponding control signal S1 to the DAQ 150 according to the first optimum stiffness coefficient $K_{c1,B}$ and the second optimum stiffness coefficient $K_{c2,B}$, and the DAQ 150 accordingly outputs a drive signal S2 (e.g., a voltage) to the amplifier 140. The amplifier 140 amplifies the drive signal S2 and outputs the amplified signal to the first driving member 111*b* and the second driving member 112*b* of the clamping device 110. The first abutting member 111*a* is driven by the first driving member 111*b* to move in a direction toward the workpiece 20 or the second abutting member 112*a*, and the second abutting member 112*a* is driven by the second driving member 112*b* to move in a direction toward the workpiece 20 or the first abutting member 111*a*. This makes the first abutting member 111*a* and the second abutting member 112*a* generate the corresponding deformation, increases or changes the first stiffness coefficient $K_{c1}$ of the first abutting member 111*a* to satisfy the first optimum stiffness coefficient $K_{c1,B}$, increases or changes the second stiffness coefficient $K_{c2}$ of the second abutting member 112*a* to satisfy the second optimum stiffness coefficient $K_{c2,B}$, and thus make the system's natural frequency $\omega_n$ of the machine tool system 10' satisfy the optimum system's natural frequency $\omega_{n,B}$.

In addition, the clamp control method of the embodiment of this disclosure is suitable for processing a thin workpiece 20. In an embodiment, a ratio (i.e., W1/T1) of a width W1 (shown in FIG. 6) to a thickness T1 (shown in FIG. 3) of the workpiece 20 applicable to the clamping system 100 is roughly equal to or greater than 10. In other words, even the workpiece 20 has a very thin thickness T1, the processing quality with the machining precision and surface finish satisfying the expected range still can be obtained under the assistance of the clamping system 100 of the embodiment of this disclosure.

Then, as shown in FIG. 3, the tool 12 starts to process (e.g., cut) the workpiece 20. Because the optimum system's natural frequency $\omega_{n,B}$ increases, the working frequency of the tool 12 during the actual processing cannot easily approach the optimum system's natural frequency $\omega_{n,B}$, and the occurrence of resonance can be effectively avoided.

In the continuous processing process, the clamping system 100 may repeatedly perform the steps S110 to S140 to instantly respond to changes in the geometry of the workpiece 20 (because of cutting) and to actively control the clamp mode (e.g. correspondingly change the clamping force, the stiffness coefficient and/or the damping coefficient), so that the working frequency of running the tool 12 and the system's natural frequency $\omega_n$ (or the optimum system's natural frequency $\omega_{n,B}$) are held within the security frequency range, and that the occurrence of resonance can be effectively avoided in the whole processing process.

In the processing process, at a first time point, the processor 130 uses the above equations (2) and (3) or any other required equation according to the first damping coefficient $C_{c1}$, the second damping coefficient $C_{c2}$, the first stiffness coefficient $K_{c1}$ and the second stiffness coefficient $K_{c2}$ at that time to re-calculate the optimum system's natural frequency $\omega_{n,B}$ at a second time point (e.g., the next time point). In the process of calculating the optimum system's natural frequency $\omega_{n,B}$, the processor 130 may integrate the first damping coefficient $C_{c1}$ and the second damping coefficient $C_{c2}$ at that time (e.g., at the first time point) with the system's damping coefficient C of the equation (2), integrate the first stiffness coefficient $K_{c1}$ and the first stiffness coefficient $K_{c1}$ at that time (e.g., at the first time point) to the system's stiffness coefficient. K of the equation (2), and then calculate the system's damping coefficient C at that time, the system's stiffness coefficient K at that time, the system mass M and the security frequency range to obtain the optimum system's natural frequency $\omega_{n,B}$. At the second time point, the clamping system 100 changes the clamp state of the holder on the workpiece, so that the system's natural frequency is changed to the optimum system's natural frequency $\omega_{n,B}$. In the processing process, the calculation methods for neighboring two time points are respectively the same as those for the first time point and the second time point.

Figure 4:
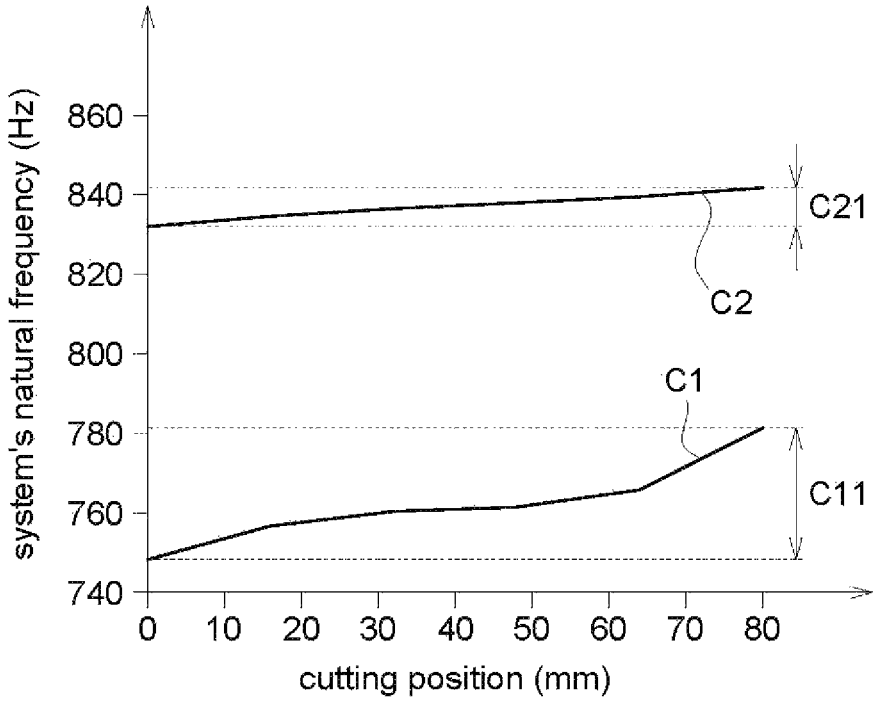
FIG. 4 is a graph showing relationships between a cutting position of the clamping system and a system's natural frequency according to the embodiment of this disclosure.

FIG. 4 is a graph showing relationships between a cutting position of the clamping system 10 and a system's natural frequency according to the embodiment of this disclosure. Referring to FIG. 4, the horizontal axis denotes the variation of the cutting position of the machining process tool 12, wherein the cutting direction is directed downwards from the top of the workpiece 20, and the vertical axis denotes the variation of the system's natural frequency $\omega_n$. The curve C1 in the graph denotes the relationship between the cutting position and the system's natural frequency when the conventional clamping system is used, while the curve C2 denotes the relationship between the cutting position and the system's natural frequency when the clamping system 100 according to the embodiment of this disclosure is used. Compared with the curve C1, the clamping system 100 according to the embodiment of this disclosure in the machining process can effectively increase the system's natural frequency $\omega_n$ (the system natural frequency of the curve C1 is lower), can decrease the variation range C21 of the system's natural frequency $\omega_n$ (the variation range C11 of the conventional system is larger), and can enhance the machining stability. In addition, according to the experimental simulation result, the vibration response can be decreased by 51% when the system's damping coefficient is increased by 63%, and the clamping system 100 according to the embodiment of this disclosure can increase the steady state area of the cutting steady state diagram (i.e., the relationship curve of the speed versus the cutting depth) by 1.18 times, and can increase the maximum machining efficiency by 38%.

Figure 5:
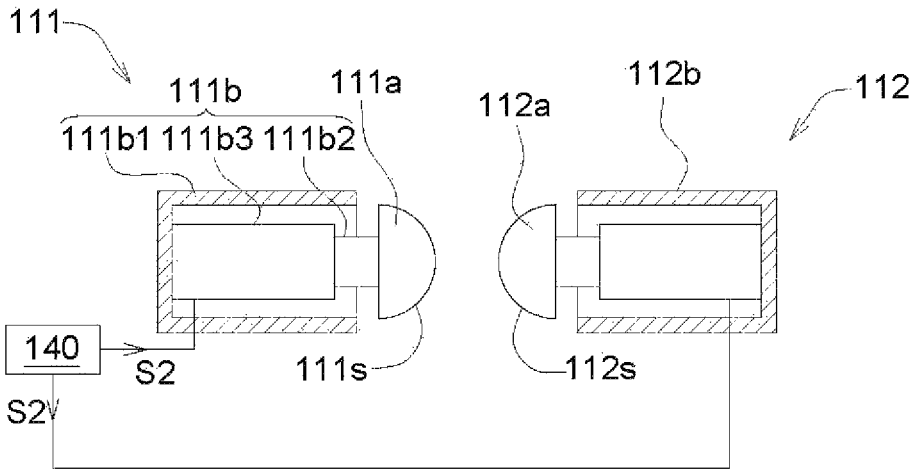
FIG. 5 is a schematic view showing the clamping device of FIG. 1.

FIG. 5 is a schematic view showing the clamping device 110 of FIG. 1. Referring to FIG. 5, the first holder 111 and the second holder 112 are driving holders, for example. Specifically speaking, the first driving member 111*b* of the first holder 111 is, for example, a piezoelectric driving member, and includes a first outer casing 111*b*1, a first connector 111*b*2 and a piezoelectricity element 111*b*3, wherein the piezoelectricity element 111*b*3 is disposed within the first outer casing 111*b*1, and the first connector 111*b*2 is fixedly connected to the piezoelectricity element 111*b*3 and the first abutting member 111*a*. The piezoelectricity element 111*b*3 is expanded or contracted, by the action of the drive signal S2, to move the first abutting member 111*a* in the direction toward the second abutting member 112*a*, or to move the first abutting member 111*a* in the direction away from the second abutting member 112*a*. As shown in the figure, a contact surface 111*s* of the first abutting member 111*a* is a portion of a spherical surface, such as a hemispherical surface. As shown in FIG. 5, the structure of the second holder 112 is similar to or the same as that of the first holder 111, and detailed descriptions thereof will be omitted here. In another embodiment, the second holder 112 may be a fixed holder, for example, and the second driving member 112*b* may be replaced by a fixing member, which does not drive the second abutting member 112*a* to move.

In addition, in other embodiments, the first driving member 111*b* may be a fluid-controlled driving member, such as a pneumatic cylinder or a hydraulic cylinder, and the second driving member 112*b* may be a fluid-controlled driving member, such as a pneumatic cylinder or a hydraulic cylinder. The relative motion of the abutting members may be controlled through the control of the fluid.

Figure 6:
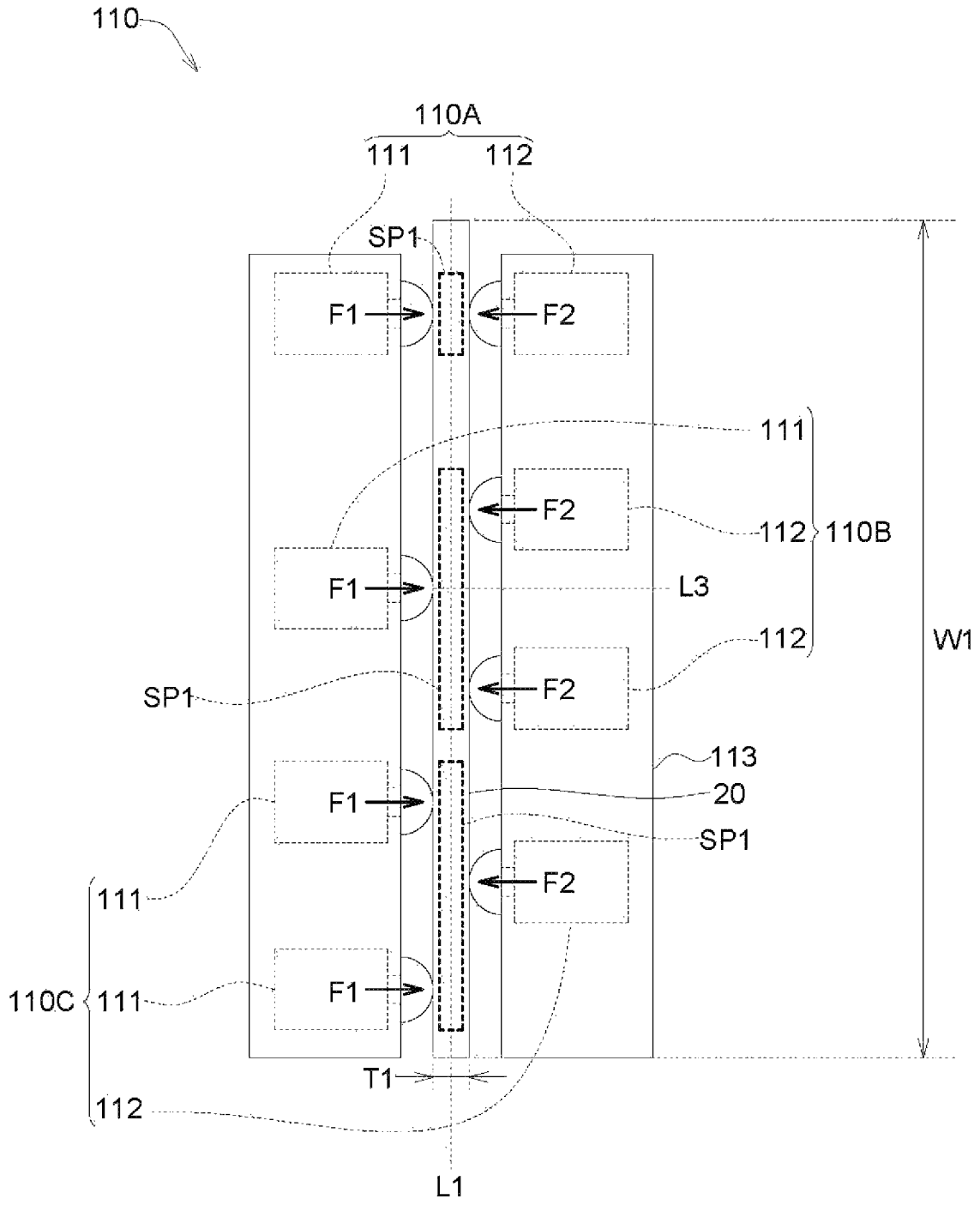
FIG. 6 is a top view showing the clamping device of FIG. 1.

FIG. 6 is a top view showing the clamping device 110 of FIG. 1. Referring to FIG. 6, the clamping device 110 includes, for example, three clamping sets, such as a first clamping set 110A, a second clamping set 1106 and a third clamping set 110C. The first clamping set 110A includes the first holder 111 and the second holder 112 disposed in an aligned manner, so that a first clamping force F1 of the first holder 111 exerting on the workpiece 20 and a second clamping force F2 of the second holder 112 exerting on the workpiece 20 are exactly aligned with each other. The second clamping set 1106 includes a first holder 111 and two second holders 112 staggered with the first holder 111, and the first holder 111 is substantially located at a position between the two second holders 112, so that an extension line L3 (e.g., an extension line of a center axis of the first abutting member 111*a* of the first holder 111) of the first clamping force F1 of the first holder 111 exerting on the workpiece 20 passes through a gap between the second clamping forces F2 of the two second holders 112 exerting on the workpiece 20. The third clamping set 110C includes a second holder 112 and two first holders 111 staggered with the second holder 112, and the second holder 112 is substantially located at a position between the two first holders 111, so that the second clamping force F2 of the second holder 112 exerting on the workpiece 20 extends through a gap between the first clamping forces F1 of the two first holders 111 exerting on the workpiece 20.

In another embodiment, one or two of the first clamping set 110A, the second clamping set 1106 and the third clamping set 110C may be omitted in the clamping device 110.

Several clamping sets of the clamping device 110 of this embodiment are arranged in a straight line L1, and can clamp the flat workpiece 20 accordingly. Specifically speaking, a gap SP1 is formed between the second holders 111 and the second holder 112 of each clamping set, and several gaps SP1 of several clamping sets are arranged in a straight line L1 so that the flat workpiece 20 can be clamped. However, the embodiment of this disclosure is not restricted thereto.

Figure 7:
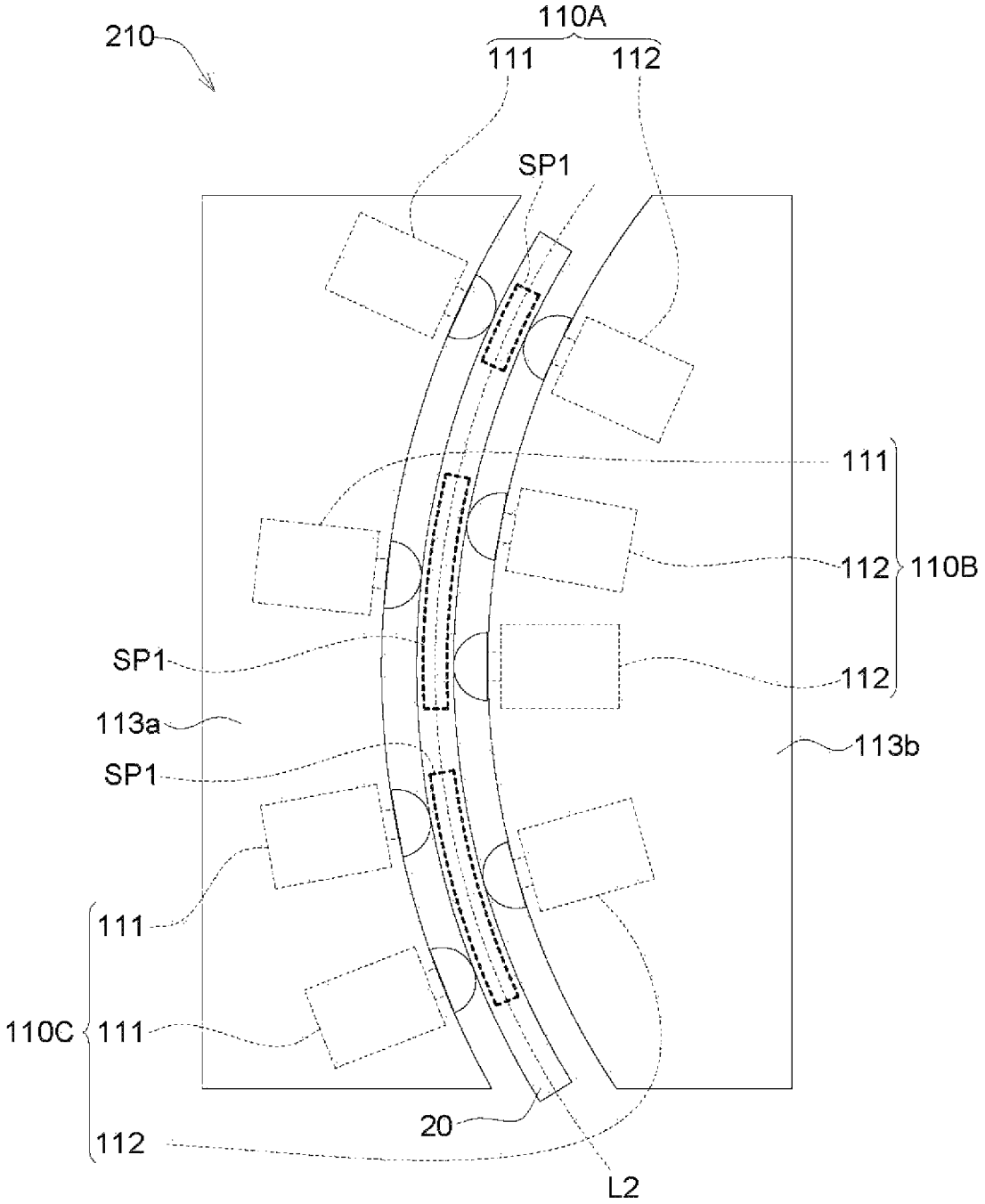
FIG. 7 is a top view showing a clamping device according to another embodiment of this disclosure.

FIG. 7 is a top view showing a clamping device 210 according to another embodiment of this disclosure. Referring to FIG. 7, the clamping device 210 of this embodiment includes, for example, three clamping sets, such as the first clamping set 110A, the second clamping set 1106 and the third clamping set 110C. What is different from the clamping device 110 of FIG. 6 is that several gaps SP1 of several clamping sets in this embodiment are arranged in a curve L2. In other embodiments, several gaps SP1 of several clamping sets of the clamping device 110 may be arranged in the combination of the straight line and the curve to clamp the workpiece 20 having the irregular or complex geometric pattern. In addition, the control method of the clamping device 210 is similar to that of the clamping device 110, and detailed descriptions thereof will be omitted here.

Figure 8:
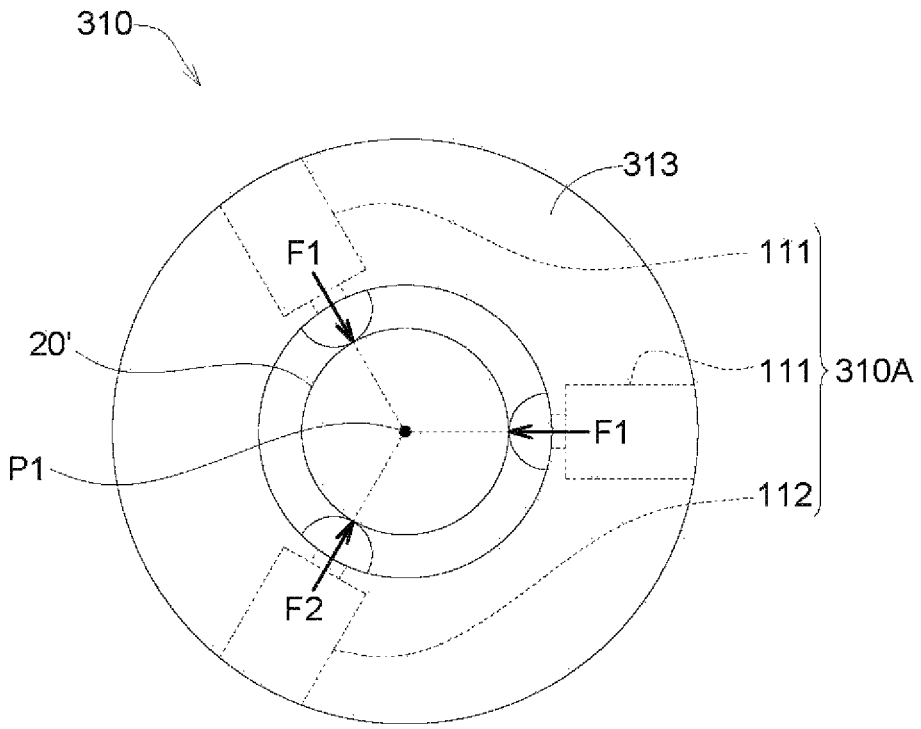
FIG. 8 is a top view showing a clamping device according to another embodiment of this disclosure.

FIG. 8 is a top view showing a clamping device 310 according to another embodiment of this disclosure. Referring to FIG. 8, the clamping device 310 includes, for example, a clamping set 310A and a clamping base 313, wherein the clamping set 310A is disposed in the clamping base 313. The clamping set 310A includes at least one first holder 111 and at least one second holder 112. Although there are three holders exemplified, there may be two or more than three holders. The holders are the driving holders. The center axes of the holders intersect at a center point P1 of the clamping base 313. The workpiece 20' is clamped by the holders. When the workpiece 20' is clamped by the holders, the center of the workpiece 20' may be substantially aligned with the center point P1 of the clamping base 313. The clamping device 310 of this embodiment may be rotated to rotate the workpiece 20', which is machined (e.g., lathe cutting) by the tool (not shown). In addition, the control method of the clamping device 310 is similar to that of the clamping device 110, and detailed descriptions thereof will be omitted here.

In summary, the clamping device according to the embodiment of this disclosure may include N clamping set(s), where N is an arbitrary positive integer equal to or greater than 1. Each clamping set includes at least two holders, and at least one of the holders of each clamping set is the driving holder, such as a piezoelectric holder or fluid-controlled holder. Each clamping set clamps the workpiece between the holders, and the force exerting directions of the holders on the workpiece intersect at a common point or are substantially parallel to each other (in a fully overlapped manner or a staggered manner), for example. A gap is present between these holders to receive the workpiece. The holder on one side of the gap is the driving holder, and the holder on the other side of the gap may be the driving holder or fixed holder.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A clamping device adapted to be installed on a machine tool to clamp a workpiece, the clamping device comprising:
- a first holder, comprising:
  - a first abutting member; and
  - a first driving member connected to the first abutting member; and
- a second holder comprising a second abutting member;
- wherein the first abutting member and the second abutting member are oppositely disposed and spaced apart from each other to receive the workpiece, the first driving member is coupled to the first abutting member to drive the first abutting member to move in a direction toward the second abutting member to clamp the workpiece between the first abutting member and the second abutting member;
- wherein the clamping device further comprises:
  - a plurality of clamping sets, wherein each of the clamping sets comprises the first holder and the second holder, and the clamping sets are arranged in a curve.

2. The clamping device according to claim 1, wherein the first driving member is a piezoelectric driving member or a fluid-controlled driving member.

3. The clamping device according to claim 1, wherein the second holder is a fixed holder.

4. The clamping device according to claim 1, wherein the second holder further comprises a second driving member, and the second driving member is coupled to the second abutting member to drive the second abutting member to move.

5. The clamping device according to claim 1, wherein the first abutting member and the second abutting member are disposed in an aligned manner.

6. The clamping device according to claim 1, wherein the first abutting member has a first damping coefficient, and the first damping coefficient is equal to a product of a specific damping capacity (SDC) and a tensile strength of the first abutting member.

7. The clamping device according to claim 1, further comprising:
- two the second holder, wherein the two second holders are staggered with the first holder.

8. The clamping device according to claim 1, comprising two the second holder, wherein a center axis of the first holder and center axes of the two second holders intersect at one point, and the first holder and the two second holders are driving holders.

9. The clamping device according to claim 1, wherein each of the first abutting member and the second abutting member has a contact surface, and the contact surface is a portion of a spherical surface.

10. A clamping system, comprising:
- a clamping device, configured to be installed on a machine tool and to clamp a workpiece, the clamping device comprising:
  - a first holder, comprising:
    - a first abutting member; and
    - a first driving member connected to the first abutting member; and
  - a second holder comprising a second abutting member;
- wherein the first abutting member and the second abutting member are oppositely disposed and spaced apart from each other to receive the workpiece, the first driving member is coupled to the first abutting member to drive the first abutting member to move in a direction toward the second abutting member to clamp the workpiece between the first abutting member and the second abutting member;
- a sensor configured to sense a response signal of the machine tool system; and
- a processor configured to:
  - analyze the response signal to obtain an equation of motion of the response signal;
  - introduce a first stiffness coefficient of the first abutting member and a second stiffness coefficient of the second abutting member into the equation of motion to obtain an optimum system's natural frequency corresponding to a first optimum stiffness coefficient and a second optimum stiffness coefficient; and
  - control the first driving member of the clamping device to drive the first abutting member to move in the direction toward the second abutting member to deform the first abutting member and the second abutting member, so that the first stiffness coefficient of the first abutting member satisfies the first optimum stiffness coefficient and the second stiffness coefficient of the second abutting member satisfies the second optimum stiffness coefficient.

11. The clamping system according to claim 10, wherein the first driving member is a piezoelectric driving member or a fluid-controlled driving member.

12. The clamping system according to claim 10, wherein the second holder is a fixed holder.

13. The clamping system according to claim 10, wherein the second holder further comprises a second driving member, and the second driving member is coupled to the second abutting member to drive the second abutting member to move.

14. The clamping system according to claim 10, wherein the first abutting member and the second abutting member are disposed in an aligned manner.

15. The clamping system according to claim 10, wherein the first abutting member has a first damping coefficient, and the first damping coefficient is equal to a product of a SDC and a tensile strength of the first abutting member.

16. The clamping system according to claim 10, further comprising:
- two the second holder, wherein the two second holders are staggered with the first holder.

17. The clamping system according to claim 10, comprising:
- a plurality of clamping sets, wherein each of the clamping sets comprises the first holder and the second holder, and the clamping sets are arranged in a straight line.

18. The clamping system according to claim 10, comprising:

a plurality of clamping sets, wherein each of the clamping sets comprises the first holder and the second holder, and the clamping sets are arranged in a curve.

19. The clamping system according to claim 10, comprising two the second holder, wherein a center axis of the first holder and center axes of the two second holders intersect at one point, and the first holder and the two second holders are driving holders.

20. The clamping device according to claim 10, wherein each of the first abutting member and the second abutting member has a contact surface, and the contact surface is a portion of a spherical surface.

* * * * *